US006533213B2

(12) United States Patent
Durrance et al.

(10) Patent No.: US 6,533,213 B2
(45) Date of Patent: Mar. 18, 2003

(54) METHOD AND APPARATUS FOR UNWINDING WEB MATERIALS

(75) Inventors: Debra Hartley Durrance, Appleton, WI (US); Scott Gerald Chapple, Neenah, WI (US); David Michael Clemens, Menasha, WI (US); Michael Lee Lohoff, Oshkosh, WI (US); Larry Dean Primeau, DePere, WI (US); Joseph Donald Schmidt, Menasha, WI (US); Richard John Schmidt, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 152 days.

(21) Appl. No.: 09/766,813

(22) Filed: Jan. 22, 2001

(65) Prior Publication Data

US 2001/0032903 A1 Oct. 25, 2001

Related U.S. Application Data

(60) Provisional application No. 60/200,961, filed on May 1, 2000.

(51) Int. Cl.[7] ..... B65H 19/00

(52) U.S. Cl. ..... 242/560.1; 242/563

(58) Field of Search ..... 242/563, 560, 242/560.1, 562.1, 566, 556; 226/176, 182

(56) References Cited

U.S. PATENT DOCUMENTS

| | | | | |
|---|---|---|---|---|
| 3,844,201 | A | | 10/1974 | Eggert et al. |
| 3,845,678 | A | | 11/1974 | Eggert et al. |
| 4,191,318 | A | * | 3/1980 | Rogers |
| 4,267,984 | A | * | 5/1981 | Box |
| 4,267,985 | A | * | 5/1981 | Rogers |
| 4,386,741 | A | * | 6/1983 | Weiss et al. |
| 4,422,587 | A | | 12/1983 | Primich |
| 4,589,811 | A | * | 5/1986 | Riccardo et al. |
| 4,666,542 | A | | 5/1987 | De Jonckheere |
| 4,794,028 | A | | 12/1988 | Fischer |
| 4,940,464 | A | | 7/1990 | Van Gompel et al. |
| 4,953,805 | A | * | 9/1990 | Rauh |
| 5,584,446 | A | * | 12/1996 | Delmore et al. |
| 5,766,389 | A | | 6/1998 | Brandon et al. |
| 5,858,515 | A | | 1/1999 | Stokes et al. |
| 5,899,406 | A | | 5/1999 | Payne |
| 5,957,402 | A | | 9/1999 | McEathron et al. |
| 5,997,522 | A | | 12/1999 | Provost et al. |
| 6,012,664 | A | | 1/2000 | Duclos et al. |
| 6,086,011 | A | | 7/2000 | Shibazaki et al. |

FOREIGN PATENT DOCUMENTS

| | | |
|---|---|---|
| WO | WO 00/37009 A2 | 6/2000 |

* cited by examiner

*Primary Examiner*—William A. Rivera
(74) *Attorney, Agent, or Firm*—Thomas M. Gage

(57) ABSTRACT

A method and apparatus for unwinding a web material that defines a plurality of integral lanes with separators disposed between the lanes. At least one lane of the web material can be torn along a separator without using a cutting or slitting device while maintaining one or more other lanes on the roll.

31 Claims, 6 Drawing Sheets

METHOD AND APPARATUS FOR UNWINDING WEB MATERIALS

This application claims the benefit of Provisional applicatio Ser. No. 60/200,961, filed May 1, 2000.

BACKGROUND OF THE INVENTION

The present invention relates to methods and apparatus for unwinding web materials. More particularly, the invention pertains to methods and apparatus for unwinding web materials having a plurality of narrow lanes.

The manufacture of products such as disposable absorbent articles involves the use of narrow webs of flexible material. Such flexible materials can include, by way of illustration, nonwoven materials, elastic materials, adhesive tapes, polymeric films, release paper, mechanical fastening materials or the like. Due to their narrow widths, these flexible materials and others of this type present special handling difficulties.

For example, narrow web materials are sometimes processed in the form of planetary wound rolls, often called "cookie rolls" or "cookies" where the narrow web material is wound directly upon itself to form a narrow roll. Given the width of the web material, however, these very narrow rolls can be unstable and tend to warp or fall apart when lifted. Support members can be used to protect the cookie from distortion or damage, but that introduces a new structure and increases the processing cost of the web material and the cost to change rolls. Moreover, individual cookie rolls have a relatively short run time, which undesirably leads to frequent roll changes.

To circumvent these difficulties, narrow web materials can be level wound. By oscillating the narrow web material back and forth across the roll during winding, the level winding process yields a stable roll form that resists damage. Again, however, the level winding process can add significant expense to the web material.

Certain web materials such as molded hook fasteners have been formed into wide intermediary tapes. These wide tapes include strips of hook material separated by splitting channels or perforations. Processing of such wide tapes has to date required simultaneously separating the strips of hook material using specialized equipment such as splitting combs or slitting blades. Not only is such specialized equipment expensive to obtain and operate, but its use is practical only for converting operations that can accommodate simultaneous processing of multiple strips.

In view of these deficiencies and limitations with conventional manufacturing operations, it would be desirable to have improved methods and apparatus for unwinding narrow web materials.

SUMMARY OF THE INVENTION

In response to the above-referenced deficiencies and limitations, a new method of unwinding a web material has been discovered. The method includes providing a roll of web material that defines a plurality of integral lanes with a separator disposed between the lanes, and tearing the web material along the separator to disconnect at least one lane from at least one other lane. The selected lane is unwound from the roll while continuing to tear the web material along the separator and maintaining the other lane on the roll.

With this method, the parent roll can contain a relatively wide web of material that consists of a plurality of lanes of web material. The parent roll can provide a high degree of roll stability to minimize damage to the material during handling and storage operations. The individual lanes of web material can be unwound sequentially from the parent roll. In this way, only the number of lanes that are required for immediate processing need to be unwound. The remainder of the lanes can remain wound on the parent roll. This method can provide a stable roll form for delivering narrow lanes of material, without requiring an additional slitting operation and without the added expense of level winding or support members.

It is especially significant that the web material includes separators that enable the web material to be torn into individual lanes or groups of lanes. The terms "torn" and "tearing" in the context of this application mean that at least one lane of the web material can be or is separated from at least one other lane of the web material without using a cutting or slitting device. Separators can comprise any structure or treatment that causes the web material to tear into distinct lanes. In particular embodiments, suitable separators can comprise perforated regions, intermittently cut or slit regions, score marks, reduced thickness or reduced integrity regions, including splitting channels, creased regions, added elements or treatments that direct or limit tearing to a defined area, molded or embossed indentations, or the like. Perforation or scoring devices can be incorporated into the web production process or as a later converting step for the web material. The perforation or scoring devices can continuously or intermittently perforate, cut, or indent the web material. Alternatively, for molded web materials the material can include integral, molded-in splitting channels. The splitting channels can comprise generally longitudinal regions that have a relatively lower basis weight or less durable structure, so that the lanes can be separated along the splitting channels. Forming the web material so that it can be torn without the use of a cutting or slitting device simplifies the unwinding operation and reduces equipment and maintenance costs.

The manner in which the remaining lanes of web material are maintained on the parent roll will depend to some extend of the nature of the web material. In most cases, it may be sufficient to hold the leading ends of the remaining lanes of web material against the roll. Various means can be used to hold the remaining lanes in place, including but not limited to items such as tape, clips, clamps, bands, adhesives, cords, covers, or the like.

The present method is particularly suited for narrow webs of flexible material. The individual lanes can have any desired width, such as about 5 cm. or less or about 2 cm. or less. The parent roll on the other hand can be relatively wide and can contain any number of lanes depending upon the width of the lanes. For lane widths on the order of 2 cm., for example, the web material on the parent roll can comprise 2 or more lanes, particularly 4 or more lanes, more particularly 8 or more lanes, such as 10 to 60 lanes or more.

The present method can be used for unwinding a variety of flexible materials, such as nonwoven materials, elastic materials, adhesive tapes, polymeric films, release paper, mechanical fastening materials, or the like. Mechanical fastening materials can comprise interlocking geometric shaped materials, such as hooks, loops, bulbs, mushrooms, arrowheads, balls on stems, male and female mating components, buckles, snaps, or the like. In particular embodiments, the mechanical fastening materials comprise hook-and-loop fastening elements. Loop type fasteners typically comprise a fabric or material having a base or backing structure and a plurality of loop members extending upwardly from at least one surface of the backing structure. The loop material can be formed of any suitable material, such as acrylic, nylon or polyester, and can be formed by methods such as warp knitting, stitch bonding or needle punching. Suitable loop materials are available from Guilford Mills, Inc., Greensboro, N.C., U.S.A. under the trade designation No. 36549. Another suitable loop material can comprise a pattern un-bounded web as disclosed in U.S. Pat. No. 5,858,515 issued Jan. 12, 1999 to Stokes et al.

Hook type fasteners typically comprise a fabric or material having a base or backing structure and a plurality of hook members extending upwardly from at least one surface of the backing structure. In contrast to the loop type fasteners which desirably comprise a very flexible fabric, the hook material advantageously comprises a more resilient material to minimize unintentional disengagement of the fastener components as a result of the hook material becoming deformed and catching on clothing or other items. The term "resilient" as used herein refers to an interlocking material having a predetermined shape and the property of the interlocking material to resume the predetermined shape after being engaged and disengaged from a mating, complementary interlocking material. Suitable hook material can be molded or extruded of nylon, polypropylene or another suitable material. Hook materials are available from commercial vendors such as Velcro Industries B.V., Amsterdam, Netherlands or affiliates thereof, including specific materials identified as Velcro HTH-829 with a uni-directional hook pattern and having a thickness of about 0.9 millimeters (35 mils) and HTH-851 with a uni-directional hook pattern and having a thickness of about 0.5 millimeters (20 mils); and Minnesota Mining & Manufacturing Co., St. Paul, Minn. U.S.A., including specific materials identified as CS-600.

Hence, in another embodiment, the invention concerns a method of unwinding a mechanical fastener material. The method includes providing a roll of mechanical fastener material comprising a base and a plurality of engaging elements projecting from the base. The mechanical fastener material defines at least 3 lanes containing engaging elements with integral separators disposed between the lanes. The lanes can have a width of about 5 cm. or less. The method also includes tearing the mechanical fastener material along a separator to disconnect at least one lane from a plurality of other lanes, and unwinding the one lane from the roll while continuing to tear the mechanical fastener material along the separator. The plurality of other lanes are maintained on the roll while the one lane is unwound.

In particular embodiments the web material can comprise a hook material. The multiple lane configuration can be produced in-line in the hook production process. The parent rolls can be produced in relatively wide widths, for example from about 7 to about 100 cm. depending on the manufacturer's width constraints and tension tolerances. In one particular embodiment, by way of illustration, the web material can be divided into lanes having a width of about 1.3 cm. with separators disposed between the lanes. The separators can comprise longitudinal channels or splitting lanes of reduced thickness. For example, the base of the hook material can have a nominal thickness of about 0.3 millimeters (mm.) and the separators can have a nominal thickness at their center of about 0.05 mm. The separators can be very narrow, such as on the order of about 0.2 mm. Alternatively, the web material can comprise loop material or other mechanical fastening material.

In another aspect, the present invention also concerns an apparatus for unwinding a roll of web material having first and second integral lanes. The apparatus includes at least one roll unwind stand comprising a shaft defining an unwind axis and a drive mechanism adapted to rotate the shaft. A repositioning device, which is adapted to redirect a lane as it is unwound, is movably mounted and positionable at a plurality of positions along an axis generally parallel to the unwind axis. The plurality of positions correspond to different lane positions. The apparatus also includes a control system adapted to: move the repositioning device to a first location corresponding to at least one first lane, rotate the drive mechanism to unwind the at least one first lane, move the repositioning device to a second location corresponding to at least one second lane, and rotate the drive mechanism to unwind the at least one second lane. The second lane can remain on the roll while the fist lane is unwound.

The apparatus can also employ sensors that provide roll diameter information. Thus, in another embodiment, an apparatus for unwinding rolls of web material having a plurality of integral lanes can comprise first and second roll unwind stands. The unwind stands comprise shafts defining unwind axes and one or more drive mechanisms adapted to rotate the shafts. A repositioning device is associated with each roll unwind stand and is adapted to redirect a lane as it is unwound. The repositioning devices are movably mounted and positionable at a plurality of positions along an axis generally parallel to the respective unwind axis. The plurality of positions correspond to different lane positions. A sensing device is associated with each roll unwind stand and is adapted to provide roll diameter information. The sensing devices are movably mounted and positionable at a plurality of positions along an axis generally parallel to the respective unwind axis. Again, the plurality of positions correspond to different lane positions. The apparatus also includes a control system adapted to: move the repositioning and sensing devices of the first roll unwind stand to a first location corresponding to at least one first lane, rotate the drive mechanism of the first roll unwind stand to unwind the at least one first lane, move the repositioning and sensing devices of the first roll unwind stand to a second location corresponding to at least one second lane, rotate the drive mechanism of the first roll unwind stand to unwind the at least one second lane, move the repositioning and sensing devices of the second roll unwind stand to a first location corresponding to at least one first lane, rotate the drive mechanism of the second roll unwind stand to unwind the at least one first lane, move the repositioning and sensing devices of the second roll unwind stand to a second location corresponding to at least one second lane, and rotate the drive mechanism of the second roll unwind stand to unwind the at least one second lane. The second lanes can remain on their corresponding rolls while the first lanes are unwound.

In particular embodiments, the sensing devices can detect the position of the next lane to be unwound. Further, the control system can use sensor feedback information to control the position of the repositioning devices.

The apparatus as described herein can be used to unwind a roll of web material having first and second integral lanes, including the steps of: positioning a repositioning device at a first position corresponding to the position of the first lane, where the repositioning device is adapted to redirect a lane as it is unwound; initiating separation of the first lane from the integral second lane; feeding the first lane onto the repositioning device; rotating the roll to unwind the first lane while tearing the first lane from the second lane and maintaining the second lane on the roll; moving the repositioning device to a second position corresponding to the position of the second lane; feeding the second lane onto the repositioning device; and rotating the roll to unwind the second lane.

The present invention facilitates high-speed manufacturing of products such as absorbent articles, including diapers, training pants, incontinence products, diaper pants, feminine care products, swim pants, disposable underwear, or the like. The multiple lane configuration of the web material is particularly suited for use with production of such garments, which often employ two or more pieces formed of narrow web material such as mechanical or adhesive fasteners. In manufacturing such garments, it can be advantageous to unwind a single lane of web material and subsequently tear or cut the single lane into two or more individual strips. The strips can then be cut and applied to the garment so that there are two fasteners per product.

Particular training pants suitable for use with the present invention are disclosed in U.S. patent application Ser. No. 09/444,083, filed on Nov. 22, 1999 (corresponding to PCT application WO 00/37009 published Jun. 29, 2000) by A. Fletcher et al. and titled "Absorbent Articles With Refastenable Side Seams;" which is incorporated herein by reference. This reference describes various materials and methods for constructing training pants. Other methods and apparatus concerning the manufacture of training pants are disclosed in U.S. Pat. No. 4,940,464 issued Jul. 10, 1990 to Van Gompel et al.; and U.S. Pat. No. 5,766,389 issued Jun. 16, 1998 to Brandon et al.; which are also incorporated herein by reference.

The above-mentioned and other features and advantages of the present invention and the manner of attaining them will become more apparent, and the invention itself will be better understood by reference to the drawings and the following description of the drawings.

DEFINITIONS

Within the context of this specification, each term or phrase below will include the following meaning or meanings.

"Bonded" refers to the joining, adhering, connecting, attaching, or the like, of two elements. Two elements will be considered to be bonded together when they are bonded directly to one another or indirectly to one another, such as when each is directly bonded to intermediate elements.

"Comprising" is inclusive or open-ended and does not exclude additional, unrecited elements or method steps.

"Connected" refers to the joining, adhering, bonding, attaching, or the like, of two elements. Two elements will be considered to be connected together when they are connected directly to one another or indirectly to one another, such as when each is directly connected to intermediate elements.

"Disposable" refers to articles which are designed to be discarded after a limited use rather than being laundered or otherwise restored for reuse.

"Disposed," "disposed on," and variations thereof are intended to mean that one element can be integral with another element, or that one element can be a separate structure bonded to or placed with or placed near another element.

"Elastic" "elasticized" and "elasticity" mean that property of a material or composite by virtue of which it tends to recover its original size and shape after removal of a force causing a deformation.

"Fabrics" is used to refer to all of the woven, knitted and nonwoven fibrous webs.

"Flexible" refers to materials which are compliant and which will readily conform to the general shape and contours of the wearer's body.

"Force" includes a physical influence exerted by one body on another which produces acceleration of bodies that are free to move and deformation of bodies that are not free to move. Force is expressed in grams per unit area.

"Integral" is used to refer to various portions of a single unitary element rather than separate structures bonded to or placed with or placed near one another.

"Layer" when used in the singular can have the dual meaning of a single element or a plurality of elements.

"Member" when used in the singular can have the dual meaning of a single element or a plurality of elements.

"Nonwoven" and "nonwoven web" refer to materials and webs of material which are formed without the aid of a textile weaving or knitting process.

"Surface" includes any layer, film, woven, nonwoven, laminate, composite, or the like, whether pervious or impervious to air, gas, and/or liquids.

These terms may be defined with additional language in the remaining portions of the specification.

BRIEF DESCRIPTION OF THE DRAWINGS

The above-mentioned and other features of the present invention and the manner of attaining them will become more apparent, and the invention itself will be better understood by reference to the following description and the accompanying drawings, wherein similar features in different figures have been given the same reference numeral.

DETAILED DESCRIPTION OF THE DRAWINGS

The principles of the present invention can be used with a variety of material webs that can be incorporated into an even greater variety of products. For ease of explanation, the description hereafter will be in terms of a hook fastener material for use in disposable training pants.

Figure 1:
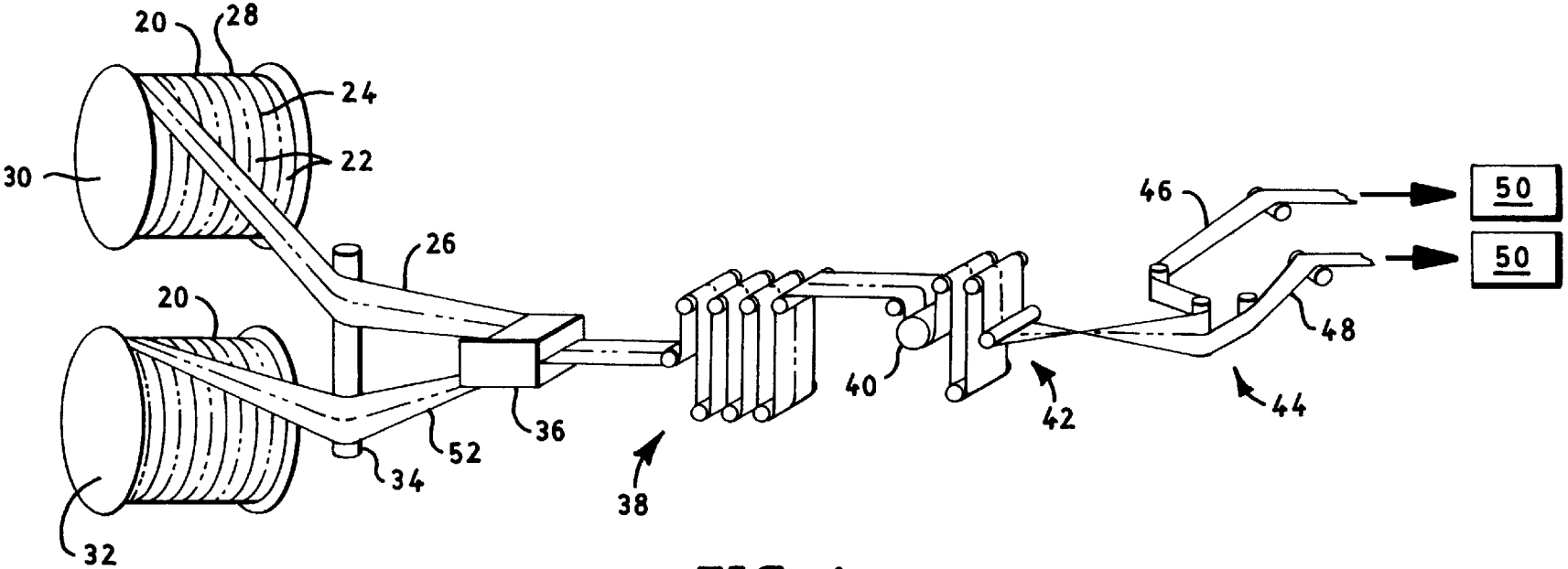
FIG. 1 schematically illustrates one embodiment of a process and apparatus for unwinding a web material according to the present invention.

One embodiment of a process and apparatus for unwinding web materials is schematically illustrated in FIG. 1. The web material 20, separately shown in FIG. 2, includes a plurality of narrow lanes 22 with separators 24 disposed between the lanes. The web material can be torn along a separator in order to disconnect at least one selected lane 26 from one or more remaining lanes 28. As the selected lane is unwound from the roll, the web material can be further torn along the separator so that the remaining lanes remain on the roll. The ends of the remaining lanes 28 can be taped down to the roll to keep them from unwinding prematurely.

To facilitate high speed operations, the process can include two or more driven rolls 30, 32 of multi-lane web material. As shown in FIG. 1, a selected lane from a first parent roll 30 can be led around a turnbar 34 to a splicing unit 36. From there the selected web can enter a festoon section 38, past a driven roll 40 and into a dancer roll 42. Upon exiting the dancer roll, the selected lane can be divided at a slitter station 44 into first and second individual strips 46, 48. Each strip can be transported to an application station 50 for incorporation into an intermediate or finished product. In this way, the present process allows two very narrow strips of material to be supplied to a garment assembly machine simultaneously from a stable roll configuration with a long run time. The selected lane can alternatively be incorporated directly into an intermediate or finished product without slitting into individual strips and/or without the other intervening steps.

In the process illustrated in FIG. 1, a selected lane 52 from a second parent roll 32 can be partially unwound and led around the turnbar 34 to the splicing unit 36. As described in greater detail below, the selected lane 52 from the second parent roll can be spliced to the tail of the selected lane 26 from the first parent roll for continuous high speed operation. This sequence can be repeated by selecting adjacent remaining lanes from the rolls 30, 32 and separating and unwinding such lanes relative to the other remaining lanes. Conventional equipment can be used for the various web handling operations, provided it is suitable for the particular web material being processed. Such web handling equipment is available from a variety of commercial vendors, such as Martin Automatic, Inc. of Rockford, Ill. U.S.A.

Figure 2:
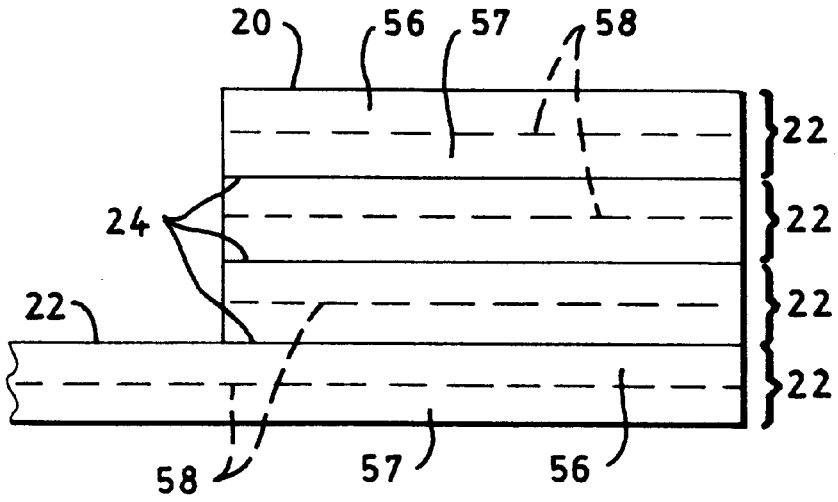
FIG. 2 illustrates a top plan view of a web material of the type shown in FIG. 1.

As used herein, the term "lane" refers to the width of material that is unwound from a parent roll which has multiple lanes across its width; the lanes can but need not comprise narrower "strips" that jointly form a lane. With reference to FIG. 2, which represents a top plan view of an exemplary web material, a web material can be formed with a plurality of lanes 22 with a separator 24 disposed between each lane. Each lane 22 comprises two strips 56, 57 with another separator 58 disposed between each strip of each lane. The illustrated web material could alternatively be unwound in lanes that each comprise a different number of strips. For particular operations, it might be desirable to consecutively unwind lanes with a different number of strips from a single roll.

The separators 24 used between lanes 22 can be the same as or different than the separators 58 used between individual strips 56, 57. For instance, it may be desirable for the separators 24 used between lanes to tear more easily than the separators 58 used between individual strips. Different separators can comprise splitting channels formed with different depth or width dimensions; score marks or perforations with different dimensions or penetration depths; or the like.

Figure 3:
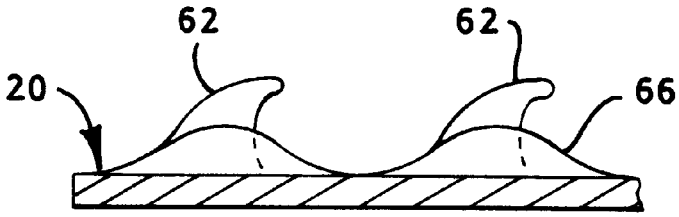
FIG. 3 illustrates a sectional side view of an exemplary hook fastening material for use with the methods and apparatus of the present invention.
Figure 4:
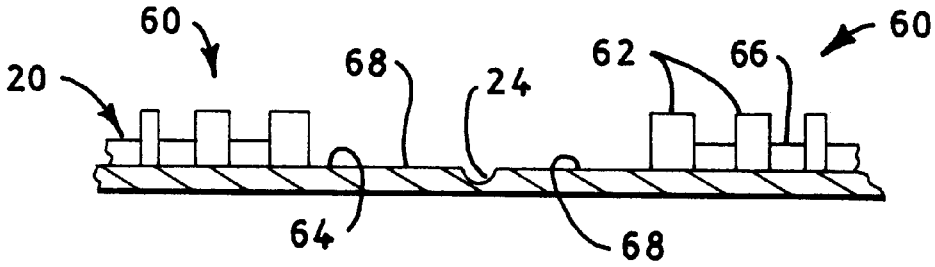
FIG. 4 illustrates a sectional end view of the hook fastening material shown in FIG. 3.

The web material 20 can comprise a hook fastening material such as the type illustrated in FIGS. 3 and 4. The side section view of FIG. 3 is taken from a plane parallel to the separators 24, and the end section view of FIG. 4 is from a plane perpendicular to the separators 24. The exemplary hook fastener material 20 can comprise groupings 60 of hooks 62 that are arranged in a plurality of rows. The hooks desirably extend upward from a base 64 of the hook material. Rip-stops 66 which are known and commonly employed in the art can be incorporated in the hook material between the hooks. The hooks can all face in the same direction as illustrated or can face in multiple directions. The groupings of hooks can but need not be separated from one another by selvage areas 68. Longitudinal separators 24 in the form of narrow splitting channels can be disposed between the groupings of hooks, such as in the selvage areas. The hooks, base, rip-stops and separators can be integrally formed, in a wide variety of sizes, shapes and patterns. Examples of particular hook materials and their method of manufacture are disclosed in U.S. Pat. No. 4,794,028 issued Dec. 27, 1988 to Fisher and U.S. Pat. No. 5,997,522 issued Dec. 7, 1999 to Provost et al., which are incorporated herein by reference. Suitable hook materials are available from various commercial vendors such as Velcro Industries B.V., Amsterdam, Netherlands or Minnesota Mining & Manufacturing Co., St. Paul, Minn., U.S.A.

A further embodiment of the present process and apparatus is illustrated in FIGS. 5–8. The first and second parent rolls 30, 32 of web material 20 are shown mounted on shafts 70 of a dual roll unwind stand 72. The unwind stand comprises a base plate 74 and a frame structure 76 mounted on the base plate. Rotary drive mechanisms 78 are attached to the frame and operatively connected to the shafts to unwind the parent rolls. The unwind stand can include backing plates 80 connected to each shaft to support and/or limit axial movement of the drive side of the rolls 30, 32.

Figure 5:
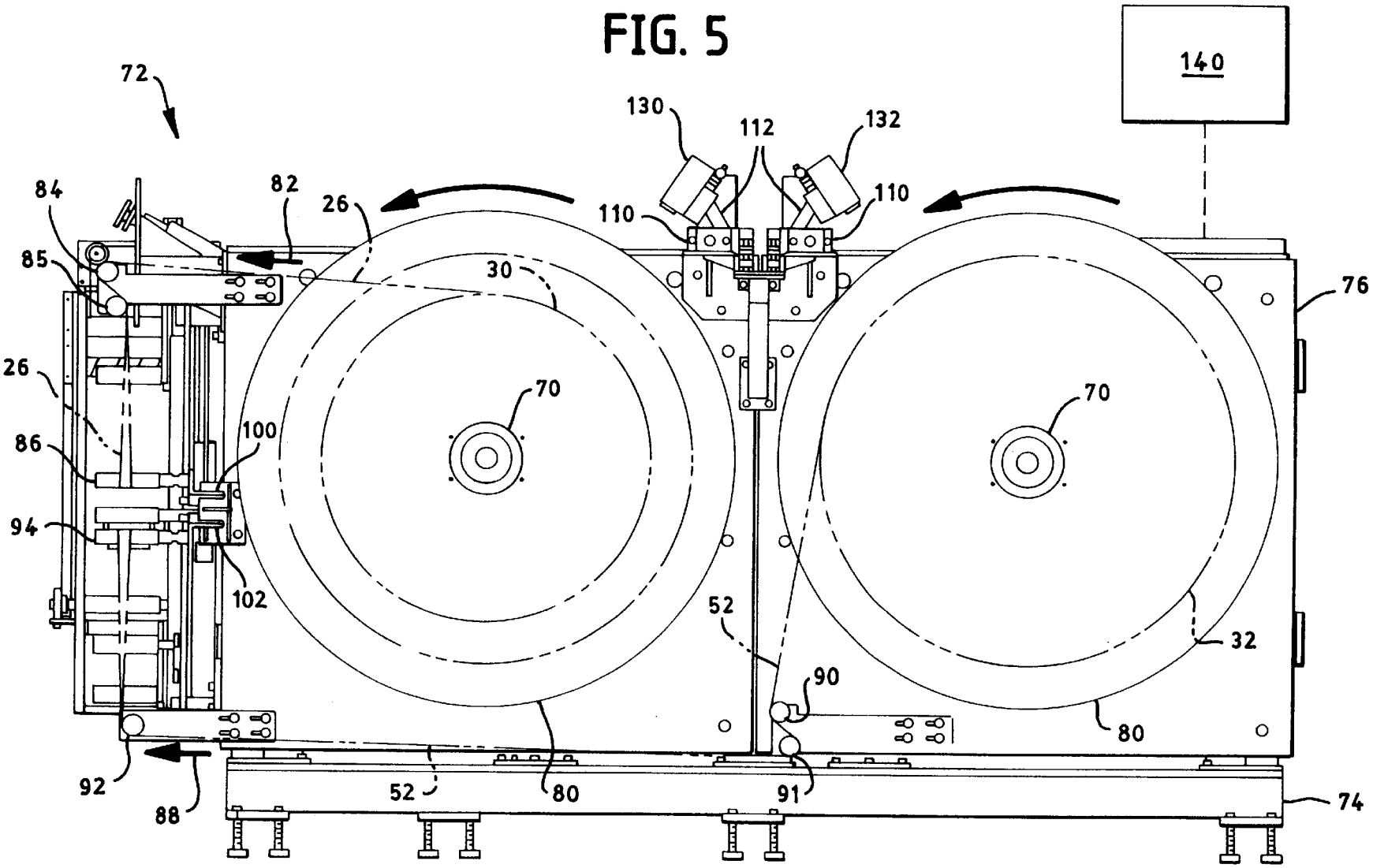
FIG. 5 illustrates a front elevation of a further embodiment of a process and apparatus for unwinding a web material according to the present invention.

With particular reference to FIG. 5, a selected lane 26 is illustrated being unwound from the first parent roll 30 in the direction of arrow 82. The selected lane 26 can be led over upper idler rolls 84 and 85, twisted 90 degrees, and fed onto an upper repositioning device 86. The term "repositioning device" as used herein refers to a driven roll, idler roll, turn bar, dead bar, web guide or the like that is adapted to redirect a lane as it is unwound. In the illustrated embodiment, the upper repositioning device comprises an upper idler roll 86 which redirects the selected lane 26 so that it is transported in a direction into the page of FIG. 5. With additional reference to FIGS. 6 and 8, the selected lane 26 thereafter travels through the splicing unit 36, into a festoon section 38, past a driven roll 40 and to a dancer roll 42.

A selected lane 52 from the second parent roll 32 is illustrated as having been threaded in the direction of arrow 88 and is to be fed to the splicing unit 36. This selected lane 52 is pulled off the second parent roll over lower idler rolls 90, 91 and 92, twisted 90 degrees, and fed onto a lower repositioning device 94. In the illustrated embodiment, the lower repositioning device comprises a lower idler roll 94 which redirects the selected lane 52 from the second parent roll 32 generally parallel to the selected lane 26 from the first parent roll 30 and into the splicing unit 36. As further illustrated, idler rolls 84–85 and 90–91 can be positioned to form S-wrap configurations to provide consistent entry and exit points to the change in web direction, and could alternatively comprise two free turning idler rolls, fixed shafts, turn bars, or the like.

Upper and lower trolley members 100 and 102 are used in the illustrated embodiment to carry the upper and lower idler rolls 86 and 94, respectively. The trolley members 100 and 102 can be slideably mounted on a beam member 104 (FIGS. 6 and 8), which can be fixedly mounted at one end to the frame structure 76. Various mechanisms can be used to permit movement of the trolley members 100 and 102 along the beam member 104, such as a dove-tail slide with a locking mechanism, a ball-slide, a combination ball-slide arrangement with a ball-screw mechanism for movement, a slotted mounting bracket, a cantilevered piece of bar stock with a clamping device, or the like. The upper trolley member 100 (FIGS. 5,6 and 8) can be movably mounted on an upper portion of the beam member 104. The upper idler roll 86 can be rotatively mounted on the upper trolley member 100. Similarly, the lower trolley member 102 can be movably mounted on a lower portion of the beam member 104, and the lower idler roll 94 can be rotatively mounted on the lower trolley member 102. The upper trolley member 100 can be adapted to move along the beam member 104 so that it is properly positioned for unwinding of each lane 22 of the first parent roll 30. Likewise, the lower trolley member 102 can be adapted to move along the beam member 104 so that it is properly positioned for unwinding of each lane 22 of the second parent roll 32. In particular, the trolley members 100 and 102 can be positioned at a plurality of positions along an axis generally parallel to the axis of the unwind shafts 70, so that the idler rolls 86 and 94 can be radially aligned with the particular lane being unwound. The upper and lower trolley members 100 and 102 are desirably capable of moving independently of one another.

Each trolley member can be adjusted by sliding it along the beam so that the center of the idle roll 86 or 94 is approximately aligned with the center of the lane being unwound. The trolley member can be reversibly locked in position with a hand-tightened set screw or other suitable means. The trolley members 100 and 102 can be adjusted manually, mechanically or electromechanically to correspond with the position of a diameter sensor 130, 132. Suitable mechanical position control devices can comprise a ball-screw linear actuator, pneumatic, hydraulic or servo cylinder, rack and pinion gear assembly, or the like, which can but need not necessarily use the sensors to detect the position of the unwinding lane.

The unwind process and apparatus desirably but not necessarily employ sensors 130, 132 to provide greater opportunity for automated operation. The sensors can detect the presence and location of the web material 20. The sensors can be used to detect the presence and location of the unwinding lane and provide feedback on the diameter of the lane, allowing accurate speed calculations as the lane diameter diminishes. Feedback from the diameter sensors 130, 132 can be used in combination with a microcontroller, computer or the like to provide automatic tracking of the successive unwind lanes, thereby minimizing operator intervention between parent roll changes. One particular sensor that is suitable for the present process is a laser sensor available from SICK OPTIK ELECTRONIK, Inc., a business having offices in St. Paul, Minn. U.S.A. Narrow beam or contact sensors can be used and are preferred to broad parabolic beam type sensors. Data from the sensors is desirably provided to a control system 140 (schematically illustrated in FIG. 5) that controls the unwinding process. Suitable control systems are available from various commercial vendors, such as Allen-Bradley, Milwaukee, Wis. U.S.A.

Figure 7:
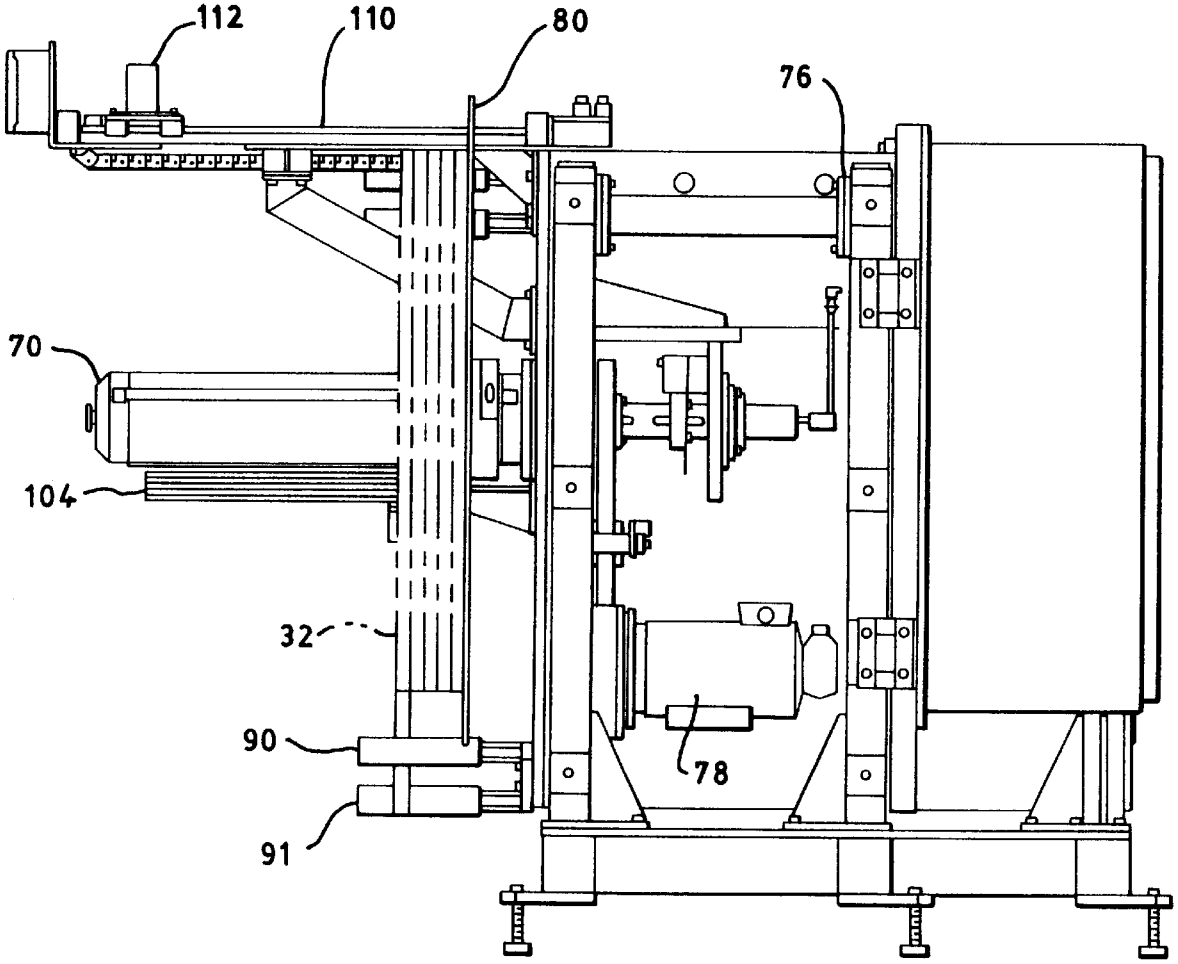
FIG. 7 illustrates a right side view of the process and apparatus of FIG. 5.
Figure 8:
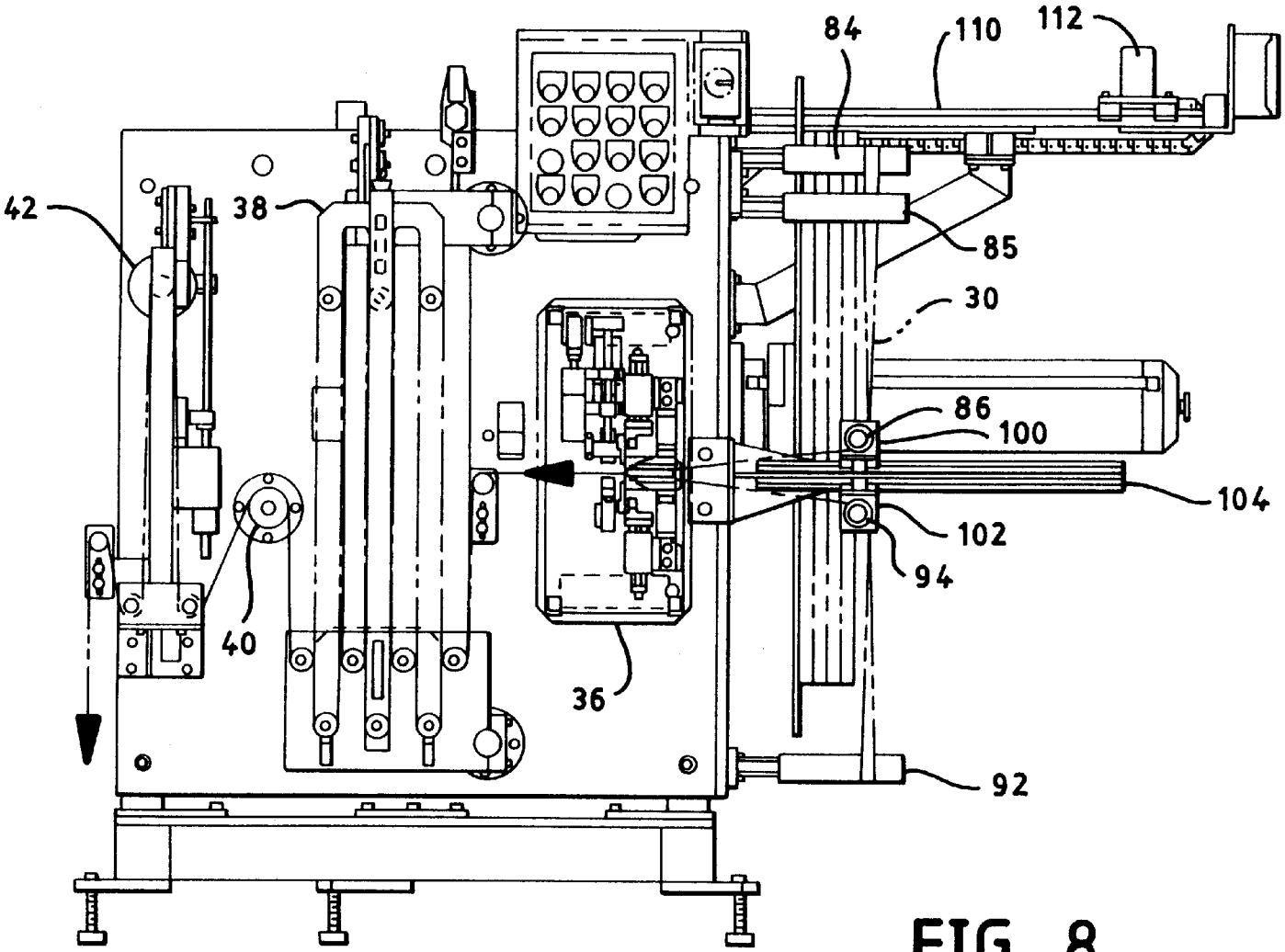
FIG. 8 illustrates a left side view of the process and apparatus of FIG. 5.

In the illustrated embodiment, first and second sensors 130, 132 are moveably mounted on rails 110 attached to the frame 76. With particular reference to FIGS. 5 and 7, the first sensor 130 and the second sensor 132 can each be mounted on brackets 112 that are slideable along the rails 110. The brackets can move independently from one another and independently from the idler rolls 86 and 94. Position control devices control movement of the sensors and brackets along the rails. The position control device can comprise a motorized ballscrew as illustrated, pneumatic cylinder, or the like, which can but need not necessarily provide position feedback data to the control system 140. The sensors can thus be adapted to move parallel to the axis of the shafts 70 so that they can be located at positions corresponding to each of the lanes of the parent rolls. The first and second sensors 130, 132 are desirably capable of moving independently from one another.

Figure 6:
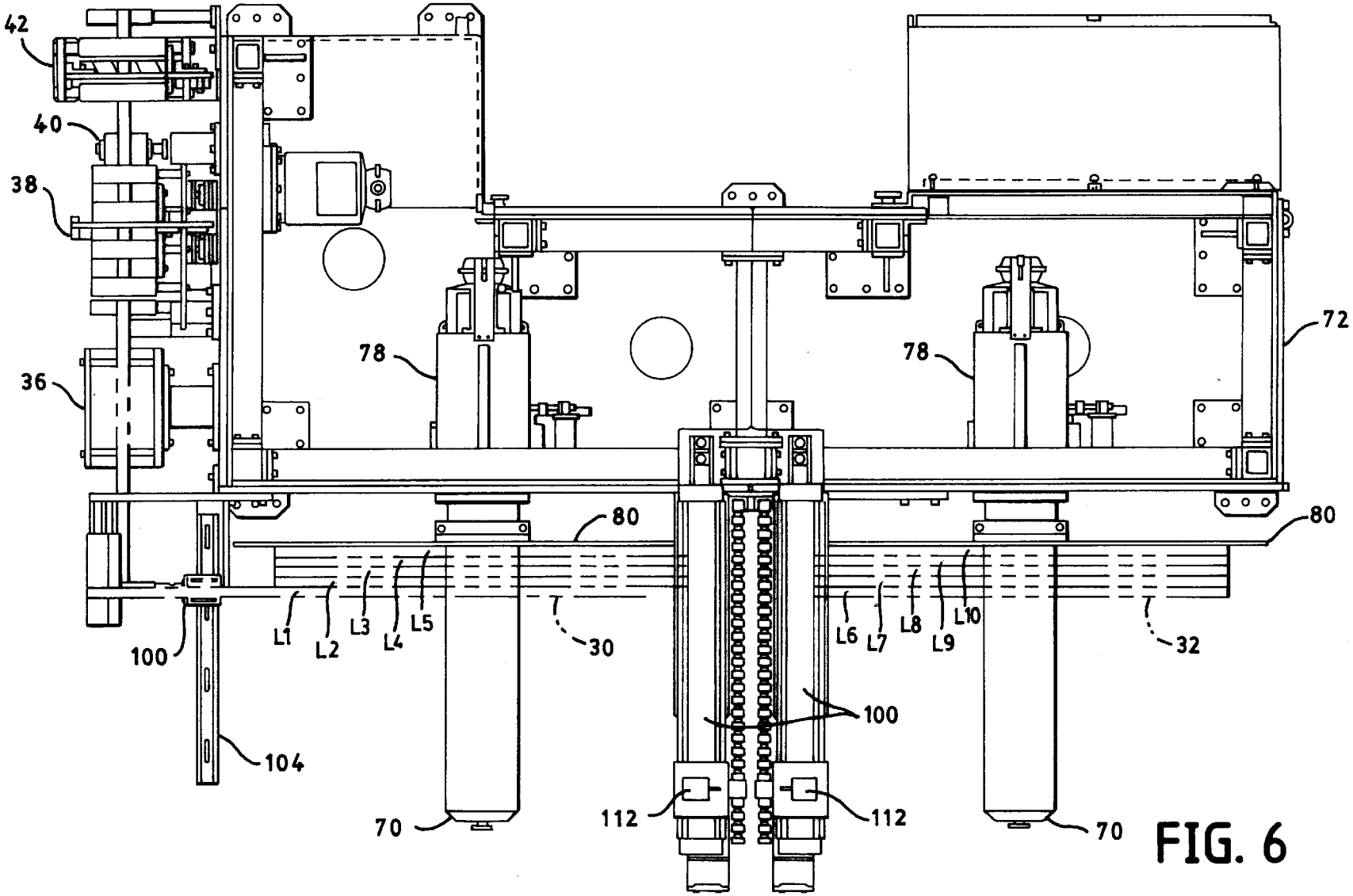
FIG. 6 illustrates a top plan view of the process and apparatus of FIG. 5.

Various sequences for unwinding lanes 22 from the parent rolls 30, 32 are possible and particular sequences will be described in relation to FIG. 6. The lanes 22 of the first parent roll 30 have been labeled L1 through L5, where L5 is closest to the backing plate 80. Similarly, the lanes 22 of the second parent roll 32 have been labeled L6 through L10, where L10 is closest to the backing plate 80. It should be understood that the rolls can comprise any number of two or more lanes and that the illustrated embodiment includes five lanes 22 per roll solely for purposes of explanation.

In one embodiment, the lanes 22 can be unwound from the parent rolls 30, 32 in a sequence that alternates back and forth between the rolls one lane at a time. For example, the sequence can be L1, L6, L2, L7, L3, L8, L4, L9, L5 and L10. While L1 is being unwound, L2 through L5 remain on the first parent roll. The beginning of L6 is spliced to the tail of L1; the beginning of L2 is spliced to the tail of L6; and so forth. Of course, other variations include reversing the starting order of the rolls, unwinding the rolls from the drive side toward the operator side, or the like. Additionally, the idler rolls 86 and 94 and the sensors 130 and 132 could be maintained stationary while the parent rolls 30, 32 are moved to create the desired relative movement. Accordingly, references herein to positioning or moving the idler rolls or sensors also encompasses positioning or moving the parent rolls to create, such relative movement.

After each selected lane is torn from the remaining lanes and fully unwound, the position of the idler roll 86, 94 can be changed to correspond to the position of the next lane to be unwound from the same parent roll. Further, the position of the sensor 130, 132 for the roll being unwound can be changed to correspond to the position of the next lane to be unwound from the same parent roll. These operations can be completed after splicing the finished lane to the head of a lane on another parent roll and during the run time of the lane from the other parent roll. Desirably, the sensor can detect the position of the next lane to be unwound from the roll and the position of the idler roll can be established based on the position detected by the sensor. After a sensor 130 or 132 is in position, the sensor can provide diameter information, which in combination with a festoon 38 position feedback signal, can be used to modulate roll unwind speed. The sensor can also provide a signal to initiate a splice sequence. The driven roll 40 feeds the web based on machine speed, and the speed of the driven roll is trimmed by the position of the dancer roll 42, as is known in the art.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

We claim:

1. A method of unwinding a web material, comprising:

providing a roll of web material defining a plurality of integral lanes with a separator disposed between the lanes;

mounting the roll of web material on a shaft that is operatively connected to a drive mechanism adapted to rotate the shaft;

tearing the web material along the separator to disconnect at least one lane from at least one other lane;

operating the drive mechanism to rotate the shaft and the roll of web material mounted thereon;

unwinding the one lane from the roll while continuing to tear the web material along the separator; and maintaining the other lane on the roll while the one lane is unwound.

2. The method of claim 1, wherein the lanes have a width of about 5 cm. or less.

3. The method of claim 2, wherein the lanes have a width of about 2 cm. or less.

4. The method of claim 1, wherein the web material comprises 8 or more lanes.

5. The method of claim 1, wherein maintaining the other lane on the roll comprises holding a lead end of the other lane against the roll.

6. A method of unwinding a web material, comprising:

providing a roll of web material defining a plurality of integral lanes with a separator disposed between the lanes;

tearing the web material along the separator to disconnect at least one lane from at least one other lane;

unwinding the one lane from the roll while continuing to tear the web material along the separator; and maintaining the other lane on the roll while the one lane is unwound;

wherein the web material comprises a multi-lane mechanical fastener.

7. The method of claim 6, wherein the web material comprises a molded hook material having a base and a plurality of splitting lanes formed in the base.

8. The method of claim 6, wherein the lanes have a width of about 5 cm. or less.

9. The method of claim 8, wherein the lanes have a width of about 2 cm. or less.

10. The method of claim 6, wherein the web material comprises 8 or more lanes.

11. A method of unwinding a web material, comprising:

providing a roll of web material defining a plurality of integral lanes with a separator disposed between the lanes;

tearing the web material along the separator to disconnect at least one lane from at least one other lane;

unwinding the one lane from the roll while continuing to tear the web material along the separator; and maintaining the other lane on the roll while the one lane is unwound;

further comprising separating the at least one lane into a plurality of strips after the at least one lane is unwound from the roll.

12. A method of unwinding a mechanical fastener material, comprising:

providing a roll of mechanical fastener material comprising a base and a plurality of engaging elements projecting from the base, the mechanical fastener material defining at least 3 integral lanes containing engaging elements with separators disposed between the lanes, the lanes having a width of about 5 cm. or less;

tearing the mechanical fastener material along a separator to disconnect at least one lane from a plurality of other lanes;

unwinding the one lane from the roll while continuing to tear the mechanical fastener material along the separator; and maintaining the plurality of other lanes on the roll while the one lane is unwound.

13. The method of claim 12, further comprising separating the at least one lane into a plurality of strips after the at least one lane is unwound from the roll.

14. The method of claim 13, wherein the plurality of strips are cut into individual mechanical fasteners and bonded to an absorbent article.

15. The method of claim 12, wherein the tearing is performed without using a cutting or slitting device.

16. A method of unwinding a roll of web material having first and second integral lanes, comprising:

mounting the roll of web material on a shaft that is operatively connected to a drive mechanism adapted to rotate the shaft;

positioning a repositioning device at a first position corresponding to the position of the first lane, the repositioning device adapted to redirect a lane as it is unwound;

initiating separation of the first lane from the integral second lane;

feeding the first lane onto the repositioning device;

operating the drive mechanism to rotate the shaft and the roll of web material mounted thereon;

unwinding the first lane from the roll while tearing the first lane from the second lane and maintaining the second lane on the roll;

moving the repositioning device to a second position corresponding to the position of the second lane;

feeding the second lane onto the repositioning device; and rotating the roll to unwind the second lane.

17. An apparatus for unwinding a roll of web material having first and second integral lanes, comprising:

at least one roll unwind stand comprising a shaft defining an unwind axis and a drive mechanism adapted to rotate the shaft;

a repositioning device adapted to redirect a lane as it is unwound, the repositioning device being movably mounted and positionable at a plurality of positions along an axis generally parallel to the unwind axis, the plurality of positions corresponding to different lane positions; and a control system adapted to move the repositioning device to a first location corresponding to at least one first lane, rotate the drive mechanism to unwind the at least one first lane, move the repositioning device to a second location corresponding to at least one second lane, and rotate the drive mechanism to unwind the at least one second lane;

wherein the second lane remains on the roll while the first lane is unwound.

18. The apparatus of claim 17, wherein the repositioning device is selected from a driven roll, an idler roll, a turn bar, a dead bar, and a web guide.

19. The apparatus of claim 18, wherein the repositioning device comprises an idler roll.

20. The apparatus of claim 17, wherein the repositioning device is carried on a trolley member that is slideably mounted on a beam member.

21. The apparatus of claim 20, wherein the trolley member can positioned at a plurality of positions along the beam member which correspond to positions of the integral lanes.

22. The apparatus of claim 17, wherein the control system signals a position control device to change the position of the repositioning device.

23. An apparatus for unwinding rolls of web material having a plurality of integral lanes, comprising:

first and second roll unwind stands each comprising a shaft defining an unwind axis, the roll unwind stands also comprising one or more drive mechanisms adapted to rotate the shafts;

a repositioning device associated with each roll unwind stand and adapted to redirect a lane as it is unwound, the repositioning devices being movably mounted and positionable at a plurality of positions along an axis generally parallel to the respective unwind axis, the plurality of positions corresponding to different lane positions;

a sensing device associated with each roll unwind stand and adapted to provide roll diameter information, the sensing devices being movably mounted and positionable at a plurality of positions along an axis generally parallel to the respective unwind axis, the plurality of positions corresponding to different lane positions; and a control system adapted to move the repositioning and sensing devices of the first roll unwind stand to a first location corresponding to at least one first lane, rotate the drive mechanism of the first roll unwind stand to unwind the at least one first lane, move the repositioning and sensing devices of the first roll unwind stand to a second location corresponding to at least one second lane, rotate the drive mechanism of the first roll unwind stand to unwind the at least one second lane, move the repositioning and sensing devices of the second roll unwind stand to a first location corresponding to at least one first lane, rotate the drive mechanism of the second roll unwind stand to unwind the at least one first lane, move the repositioning and sensing devices of the second roll unwind stand to a second location corresponding to at least one second lane, rotate the drive mechanism of the second roll unwind stand to unwind the at least one second lane;

wherein the second lanes remains on their corresponding roll while the first lanes are unwound.

24. The apparatus of claim 23, wherein the repositioning devices are selected from driven rolls, idler rolls, turn bars, dead bars, and web guides.

25. The apparatus of claim 23, wherein the repositioning devices move independently.

26. The apparatus of claim 23, wherein the sensing devices are moveably mounted on rails.

27. The apparatus of claim 23, wherein the sensing devices move independently.

28. The apparatus of claim 23, wherein the repositioning device and the sensing device associated with each roll unwind stand move independently.

29. The apparatus of claim 23, wherein the control system signals position control devices to change the position of the repositioning devices.

30. The apparatus of claim 23, wherein the control system signals position control devices to change the position of the sensing devices.

31. The apparatus of claim 23, wherein the control system uses sensor feedback information to control the position of the repositioning devices.

* * * * *